US007147463B2

(12) United States Patent
Wong

(10) Patent No.: US 7,147,463 B2
(45) Date of Patent: Dec. 12, 2006

(54) LOCK MECHANISM FOR INCREASING THE SAFTEY OF A LIGHTER

(76) Inventor: Ming King Wong, 4/F, C 11 Wang Fung Terrace, Tai Hang, Hong Kong (HK)

( * ) Notice: Subject to any disclaimer, the term of this patent is extended or adjusted under 35 U.S.C. 154(b) by 108 days.

(21) Appl. No.: 10/686,391

(22) Filed: Oct. 15, 2003

(65) Prior Publication Data

US 2005/0084813 A1 Apr. 21, 2005

(51) Int. Cl.
*F23D 11/36* (2006.01)
*F23Q 7/12* (2006.01)

(52) U.S. Cl. ..... 431/153; 431/255

(58) Field of Classification Search ..... 431/153, 431/255, 277

See application file for complete search history.

(56) References Cited

U.S. PATENT DOCUMENTS

| | | | | |
|---|---|---|---|---|
| 3,662,136 | A | 5/1972 | Bienwald | |
| 3,847,233 | A | 11/1974 | Glover et al. | |
| 3,953,696 | A | 4/1976 | Reimann et al. | |
| 5,409,372 | A | 4/1995 | Nobuo | |
| 5,492,468 | A | 2/1996 | Cirami | |
| 5,496,169 | A | 3/1996 | Chen | |
| 5,697,775 | A | 12/1997 | Saito et al. | |
| 5,829,963 | A | 11/1998 | Ichikawa | |
| 5,897,308 | A | 4/1999 | Saito et al. | |
| 6,039,561 | A * | 3/2000 | Lei | 431/153 |
| 6,042,367 | A | 3/2000 | Saito et al. | |
| 6,126,437 | A | 10/2000 | Lixiang et al. | |
| 6,287,109 | B1 | 9/2001 | Hirota | |
| 6,439,879 | B1 | 8/2002 | Hsu | |
| 6,533,575 | B1 | 3/2003 | Man | |
| 6,599,120 | B1 | 7/2003 | Lin | |
| 6,808,386 | B1 * | 10/2004 | Huang | 431/153 |
| 2002/0025499 | A1 | 2/2002 | Adams | |
| 2002/0055076 | A1 | 5/2002 | Adams et al. | |
| 2002/0094499 | A1 | 7/2002 | Huang | |
| 2002/0115031 | A1 * | 8/2002 | Chen | 431/153 |
| 2002/0177091 | A1 | 11/2002 | Chen | |

* cited by examiner

*Primary Examiner*—Alfred Basichas
(74) *Attorney, Agent, or Firm*—McGuinness & Manaras LLP

(57) ABSTRACT

A child resistant lighter includes a housing having a trigger slideably mounted thereon. A latch, internal to the housing, prevents movement of the trigger and thus prevents ignition of the lighter. A lever is pivotally mounted on the trigger. In one position, the lever is flush with the trigger, and not readily discernable as a lock release mechanism. In a second position, the lever is raised off of the trigger. In the raised position, the lever contacts the latch to slide the latch in a direction that enables movement of the trigger.

29 Claims, 7 Drawing Sheets

LOCK MECHANISM FOR INCREASING THE SAFTEY OF A LIGHTER

FIELD OF THE INVENTION

This invention relates to a lighter and more particularly to an apparatus for securing the lighter to prevent misuse.

BACKGROUND OF THE INVENTION

As it is known in the art, lighters are typically equipped with safety mechanisms for preventing the use of the lighter by children. Lighters generally have a trigger which, when depressed causes an igniting device to ignite fuel within the lighter. The safety mechanisms typically include mechanisms to lock the trigger to prevent movement and subsequent ignition of the fuel.

A variety of locking mechanisms have been provided to date. For example, conventional utility lighters generally include a lock switch placed on the housing of the lighter which requires a user to push the switch into an unlocked position to enable depression of the trigger of the lighter. Often such a configuration is insufficient to prevent the misuse of the lighter; either because the user may forget to return the switch to the locked position, or because a child may relatively easily figure out how to operate the device. An improved locking mechanism includes a spring loaded latch that is placed on the housing, a distance from the trigger, requiring the user to push against the latch to unlock the trigger while activating the trigger. When pressure is taken off the latch, it returns to an unlocked position. Such a lighter configuration is advantageous because it prevents the above problems of the trigger being left unsecured. In addition, because the latch is placed at a distance from the trigger, it is often difficult for a child to engage both the latch and trigger simultaneously due to their smaller sized hands. However, such a latching device requires a certain dexterity that is often difficult for the average user. Similar problems exist with other types of locking mechanisms, such as that disclosed in U.S. Pat. No. 6,599,120, by Lin, which require a simultaneous pushing of a safety lever and sliding of a trigger by an individual. While the motion is difficult for small children, it is also often difficult for the elderly or physically limited to perform. It would be desirable to provide a lighter having a safety mechanism that would be easily manipulated by the proper individuals but still prevent misuse by children.

SUMMARY OF THE INVENTION

It is an object of the present invention to provide a safety mechanism for lighters to reduce the probability that inexperienced users such as children will be capable of activating the lighter.

It is a second object of the present invention to provide an improved device for maximizing safety in lighters without compromising ease of use.

According to one aspect of the invention, a lighter includes a housing, a trigger slideably mounted on the housing and including a lever pivotally mounted on the trigger, the lever having a first, locked position for locking the lighter and a second position for permitting use of the lighter.

According to another aspect of the invention, a child resistant lighter includes a housing, a trigger enclosure slideably mounted on the housing, a first ignition medium disposed a portion of the trigger enclosure within the housing and a second ignition medium disposed in the housing. A slideable latch is provided, having a first position for prohibiting movement of the trigger enclosure within the housing and thereby prohibiting contact of the first ignition medium and the second ignition medium and a second position enabling movement of the trigger enclosure within the housing and thereby permitting contact of the first ignition medium and the second ignition medium. A lever is coupled to the trigger, for controlling movement of the latch.

According to another aspect of the invention, a lighter comprises a housing, the housing having an external shell and an internal plate extending there through defining an ignition cavity and a trigger cavity. The lighter also includes a trigger enclosure, having a first internal wall adjacent to the internal plate of the housing and a second wall having an extension that extends beyond the shell of the housing, the trigger comprising a lever mounted pivotally thereon and a latch, slideably positioned to extend through a slot, the slot extending through the internal plate of the housing and the internal wall of the trigger enclosure, the latch having a first position extending through the slot of the internal plate and the trigger enclosure to prevent movement of the trigger enclosure within the trigger cavity, and a second position extending into the trigger cavity and not within the slot of the internal plate, thereby permitting movement of the trigger enclosure within the trigger cavity, wherein movement of the latch to the second position is controlled by the lever.

According to another aspect of the invention, a lighter includes a housing, the housing including a first ignition means and a second ignition means, the contact of the first and second ignition means resulting in ignition of the lighter, a trigger, the movement thereof for causing contact of the first and second ignition means. means for preventing movement of the trigger; and means, pivotally mounted on the trigger, for enabling movement of the trigger.

DETAILED DESCRIPTION

Figure 1:
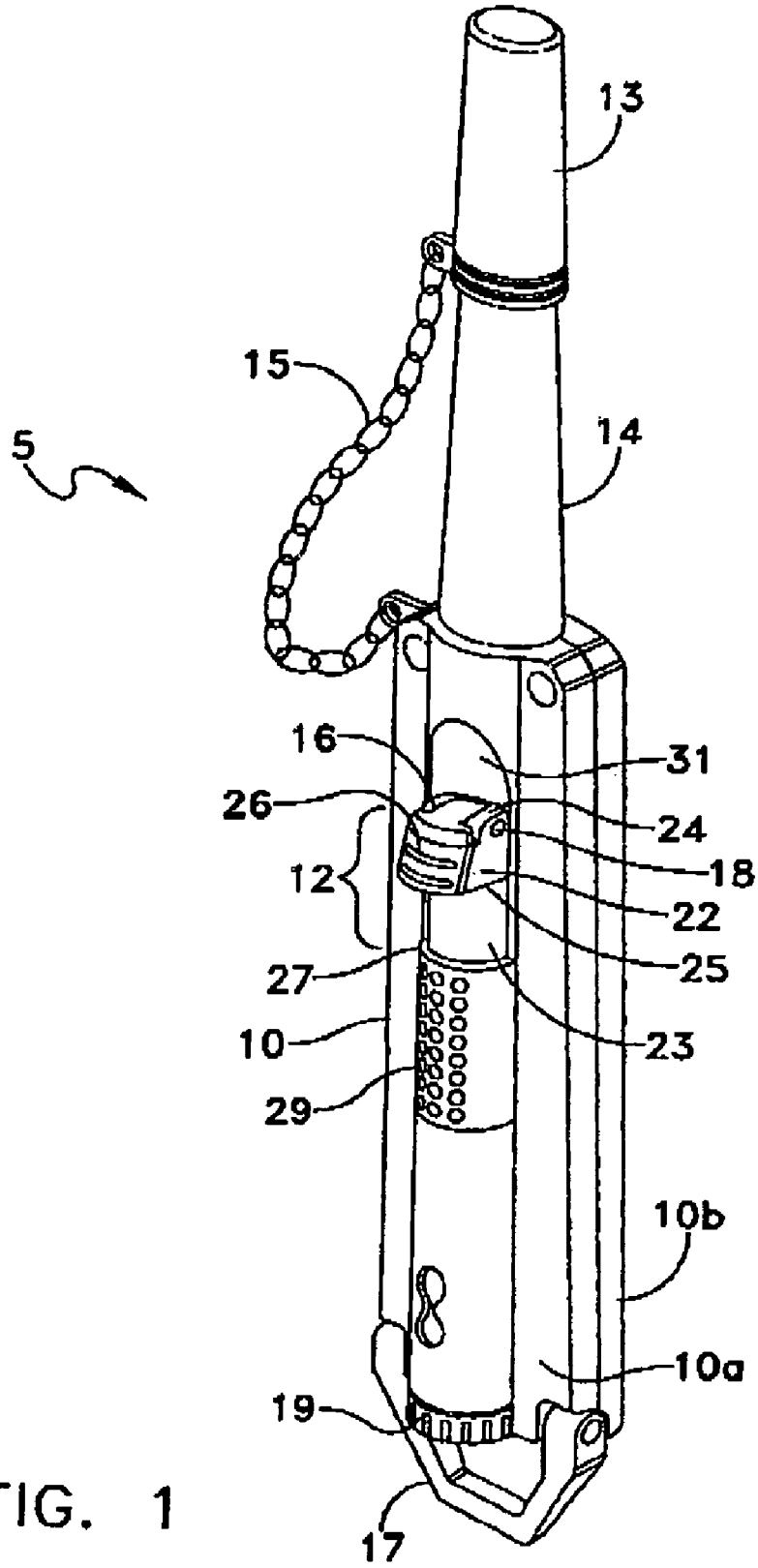
FIG. 1 is a perspective view of a lighter according to the present invention.

Referring now to FIG. 1, a perspective view of a lighter 5 having a trigger mounted safety mechanism according the present invention is shown to include a housing 10, a trigger 12, slideably mounted on the housing 10, and a barrel 14 extending longitudinally from the housing 10. Housing 10 generally comprises two portions, a front housing enclosure 10*a* and a rear housing enclosure 10*b*. In FIG. 1 a cap 13 is coupled to the housing 10 via a chain 15. Also coupled to the housing 10 is a loop 17 which may be used to hang the lighter for storage when not in use. A dial 19 is coupled to the base of the housing 10, and is used to regulate a fuel input to an ignition point in the lighter 5.

According to one aspect of the invention, a lever 16 is pivotally mounted to the trigger 12 by a pin 18. In the locked position, as shown in FIG. 1, the lever 16 is positioned to lie flush against the trigger and has a length matched to a front face of the trigger. The lever 16 is advantageously formed of the same material as the trigger (aluminum, steel or plastic, for example), and in the flush position appears to be integrated with the trigger. Thus, the location of the trigger on the lighter is partially obscured, thereby making it difficult for an uneducated user to determine the method for unlocking the trigger and igniting the lighter.

The external surface of the trigger is shown in FIG. 1. The trigger is shaped to include an extension 22 and a neck 23. The extension has a top face 24 that contacts the lever 16 when the trigger is in locked position, and a bottom face 25 that is adjacent to the neck 23. When the trigger is unlocked and depressed, the neck 23 slides into the housing until the extension 22 meets a stop edge 27 of the housing 10. The extension 23 is shown to advantageously include at least one raised ridge feature 26. The raised ridge 26 on the extension 22 serves to enhance the grip on the trigger and though desirable is not a requirement of the invention. Additional ridged details 29 may also be advantageously provided on the housing for gripping purposes.

In one embodiment of the invention the trigger 12 lies in a depression in the housing 10. At least a portion 31 of the depression extends beyond the trigger to form a concave opening on an external face of the housing. As will be described in more detail below, to unlock the trigger, the lever 16 is pivoted upwards, off the trigger to a position substantially perpendicular to the top face of the trigger and pushed into the portion 31 of the depression. While the depression provides a cavity into which the lever may be pivoted for unlocking the trigger, it is not a limiting feature of the invention.

Figure 2A:
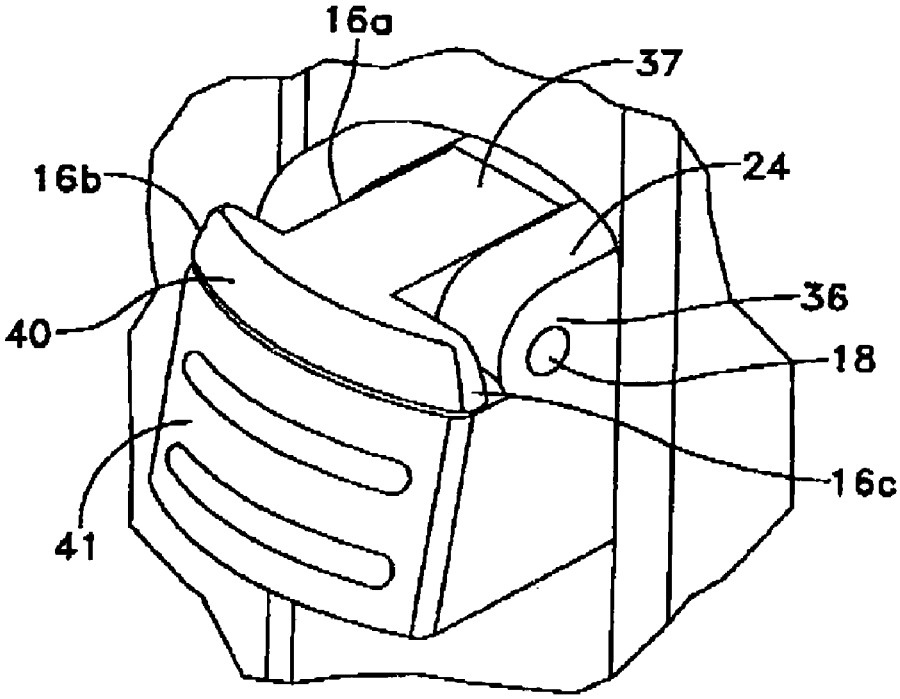
FIGS. 2A and 2B are exploded views of the trigger of the lighter of FIG. 1, illustrating a lever mounted on the trigger is a locked and unlocked position, respectively.
Figure 2B:
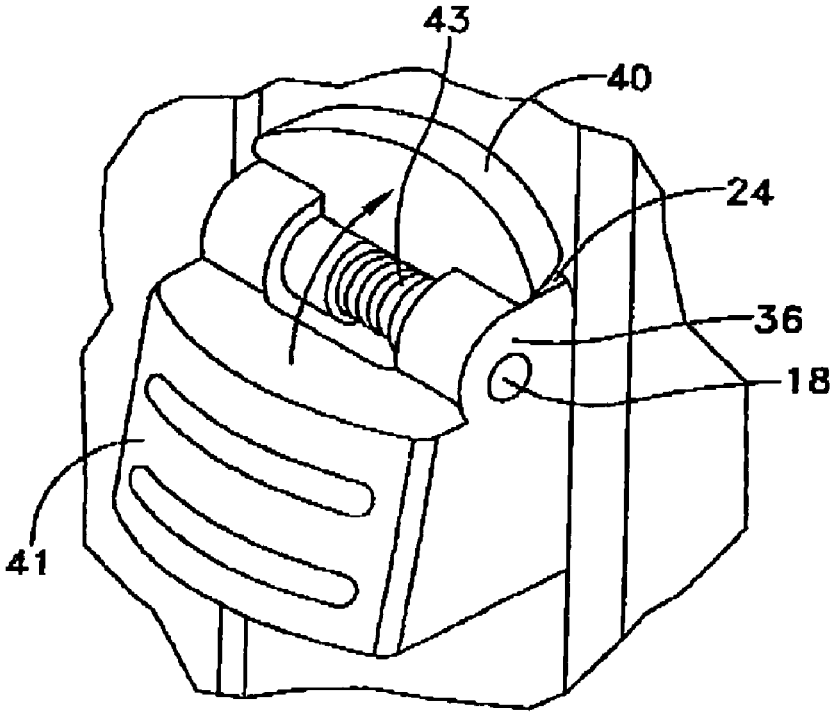

Referring briefly to FIGS. 2A and 2B, exploded views of the trigger 12 with lever 16 are provided. The lever is generally T shaped, having a neck portion 16*a*, and two extensions 16*b* and 16*c*, although the T shape is not a requirement of the invention. A collar 36 is formed on the trigger 12, and the lever 16 is aligned with the collar 36 to allow the passage of pin 18 through a hole in the neck of the lever to provide a pivot point for the lever on the trigger. When the lever is in a closed position (as illustrated in FIG. 2A), a top surface 37 of the lever 16 is substantially flush with a top surface of the trigger collar 36. A length $L_L$ of the lever is selected such that an exterior lip 40 of the lever is substantially flush with an exterior face 41 of the trigger extension 23. With such an arrangement, when the lever is in a closed position it is relatively difficult for an uneducated user of the lighter to determine the method for unlocking the trigger.

However, once the lock is detected, the lever and trigger arrangement allows for easy, one finger manipulation of the lock/trigger combination. Thus, as shown in FIG. 2B a user may use one thumb to both raise the lever off the trigger and then depress the trigger for ignition. As shown in FIG. 2B, a torsion spring 43 is advantageously used in the coupling of the lever 16 and the trigger 12. The torsion spring naturally urges the lever into the flush position with the trigger. Thus, without interference the lighter remains in a locked position. The action of a user sliding a thumb between the trigger and the lever causes the lever to be raised off the trigger. The mere presence of the thumb on the trigger will cause the lever to remain in a raised position, without any additional movement or pressure by the individual using the lighter. Such an arrangement is an improvement over prior art safety devices which require multi-digit positioning and differing movements, which are often difficult for the non-dexterous to achieve. Thus, the lever and trigger arrangement of the present invention provide a security solution that is both secure and easy to manipulate.

Figure 3:
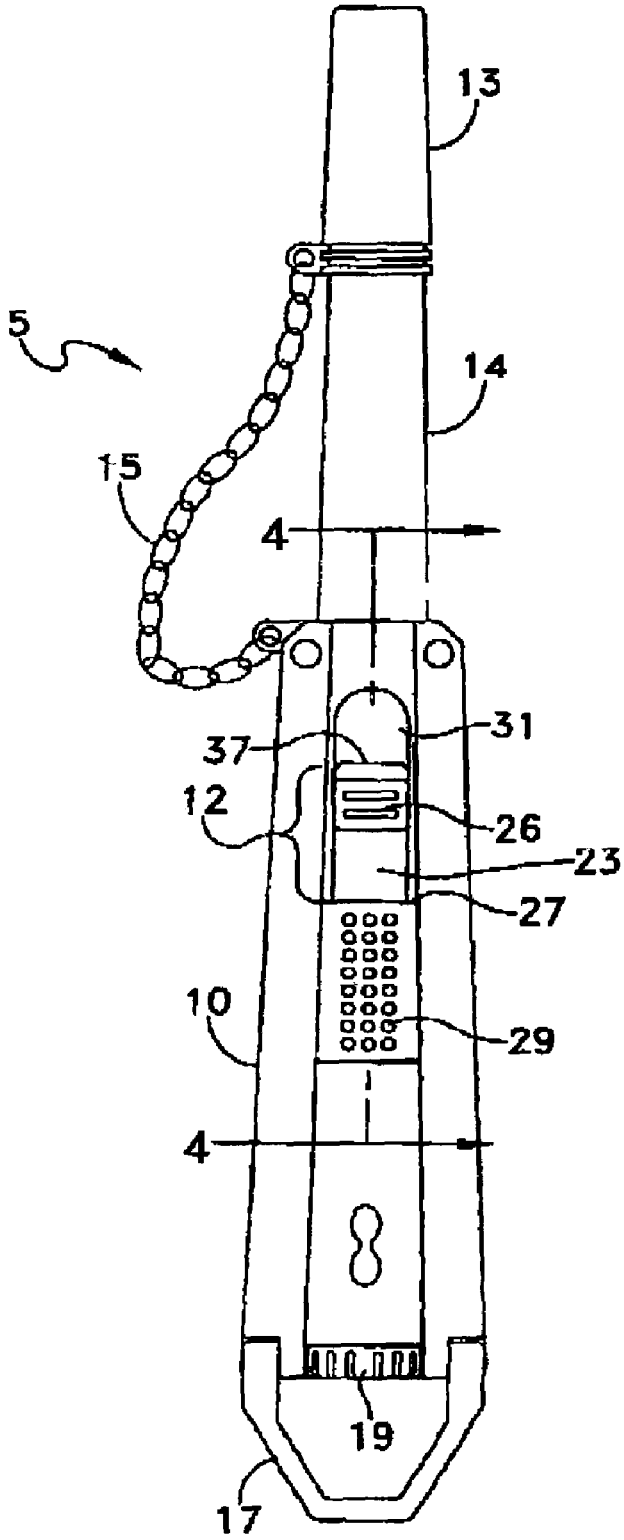
FIG. 3 is a view of the lighter of FIG. 1 taken along the perspective indicated by line A in FIG. 1.

Referring now to FIG. 3, a top down perspective of the lighter of FIG. 1 is shown. In FIG. 3, the trigger 12 is in a locked position, and the portion of the depression extends beyond the top surface 37 of the lever. The portion 31 is shaped to accommodate the lever in a raised position, and is generally sized to accommodate the typical size of a human thumb.

Figure 4:
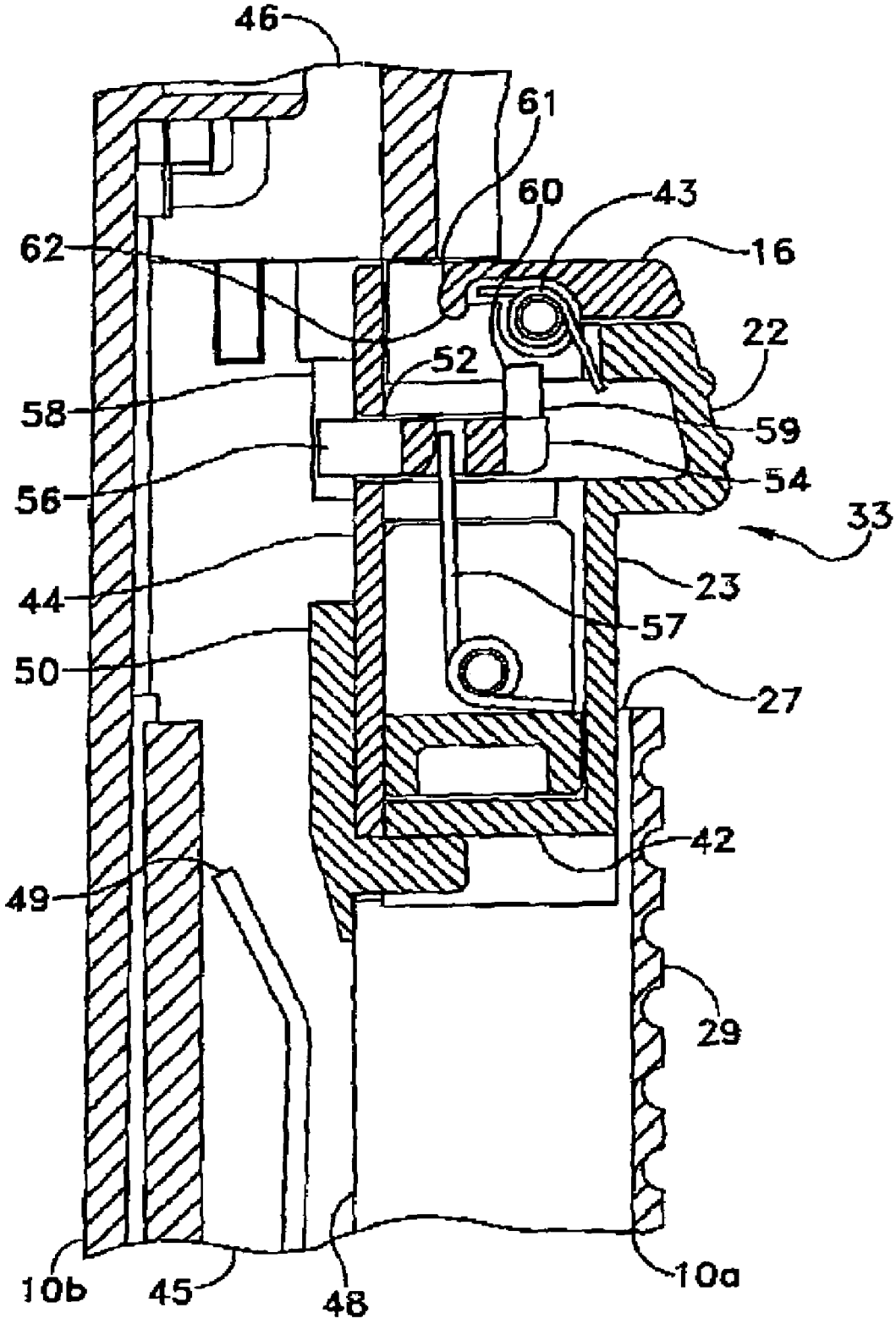
FIG. 4 is a cross sectional view of a portion of the lighter of FIG. 2, the portion being indicated by the arrows in FIG. 2, FIG. 3 illustrating a first, locked position of the trigger safety mechanism of the present invention.

Referring now to FIG. 4, a cross-sectional view of a portion of the lighter 5, (the portion indicated by arrows of FIG. 3), is provided. The lighter includes an ignition cavity 45 coupled to a fuel cavity 46 by an ignition rod 49. As described above, the lighter also includes a trigger cavity 30, defined by the outer housing 10*a* and an interior plate 48. A trigger housing 33 is disposed in the trigger cavity 30, wherein the trigger housing is defined by the trigger extension 22, the trigger neck 23, a base 42 and an interior trigger wall 44. The interior trigger wall 44 is slideably coupled to the interior plate 48. Mounted at the exterior of the interior trigger wall, extending into the ignition cavity 45 is an ignition substance 50. When the ignition substance 50 is coupled with the ignition rod 49, an electric current, voltage or spark are created, thereby heating the ignition rod and causing the ignition rod to ignite the fuel in the fuel cavity 46. Thus, the ignition substance 50 and the ignition rod 49 together provide an ignition means. Many different methods of igniting fuel sources are known in the art, and may be used interchangeably herein. For example, the igniting means may be a piezoelectric ignition device or a simple flint and steel ignition mechanisms. The present invention is not limited to any particular ignition means, rather any ignition that occurs due to the contact of two substances may be used interchangeably herein.

A slot 52 is extends through the interior trigger wall 44 and the interior plate 48. A latch 54 is disposed within the trigger housing 33, aligned with the slot 52. In a locked position a first portion 56 of the latch 54 extends through the slot into a pocket 58 of the ignition cavity, while a second portion of the latch remains in the trigger housing, thereby preventing advancement of the interior trigger wall along the interior plate 48. A spring 57 within the trigger housing urges the latch to the locked position. In one embodiment, the spring 57 is a torsion spring having a first end extending into the latch and a spring body secured in the trigger housing 33, although other alternative spring designs may also be used. Disposed on a top face 59 of the second portion of the latch 54, and extending perpendicularly from the latch is a latch lip 60.

As described previously with regard to FIGS. 2A and 2B, the lever 16 rests on the top face 47 of the trigger when the lighter 5 is in a locked position. Such an arrangement is shown in cross section in FIG. 4. FIG. 4 shows in more detail an interior edge 61 of the lever 16, which includes a lever lip 62. The spring 43 has a first end extending into the trigger cavity and a second end fixedly mounted on the interior edge 61 of the lever. The interior edge of the lever extends into the housing 10*a*. Thus, the spring 43 in a resting position urges the interior edge of the lever against the interior of the housing, essentially pushing the lever onto the face 47 of the trigger, causing the lighter to be locked against ignition.

Figure 5:
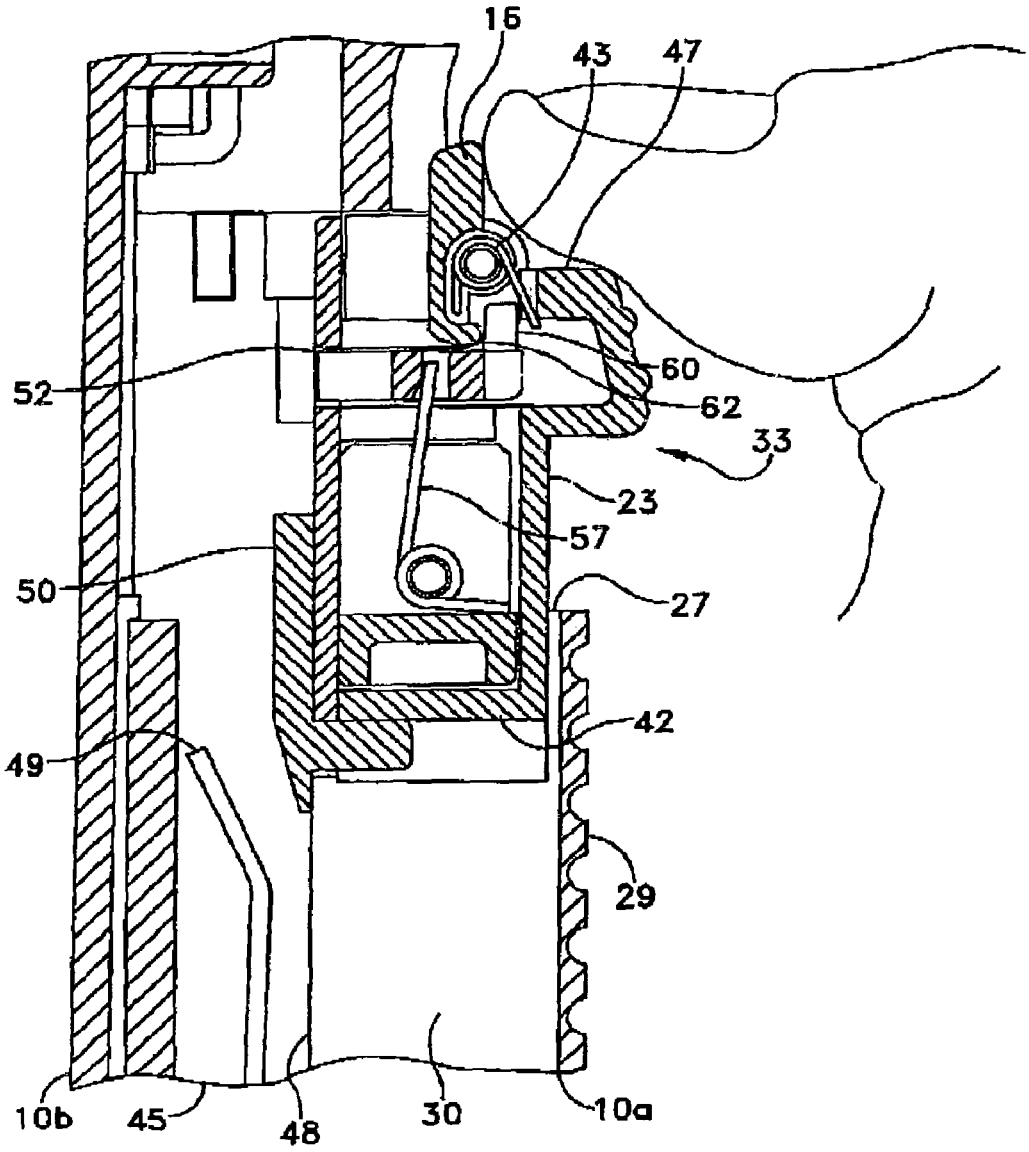
FIG. 5 is the cross sectional view of FIG. 3 illustrating a second, unlocked position of the trigger safety mechanism of the present invention.
Figure 6:
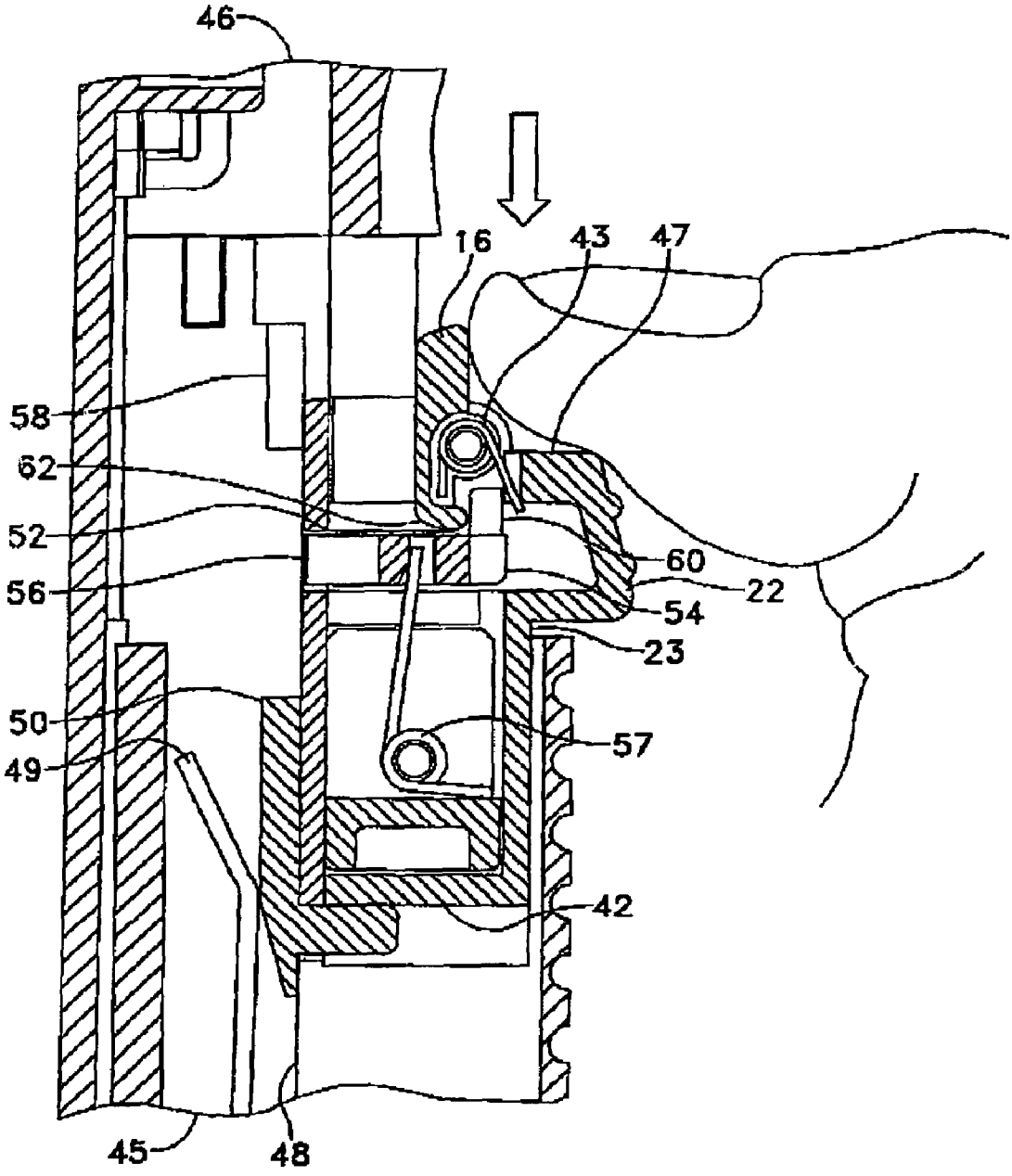
FIG. 6 is the cross sectional view of FIG. 4, illustrating the depression of the trigger following the unlocking of the trigger safety mechanism.

Referring now to FIG. 5, to use the lighter 5, a user slides a thumb between the top face 47 of the trigger and the lever 16. When the lever is urged away from the trigger, it pivots around the spring 43. The lever lip 62 engages the latch lip 60, sliding the latch 54 into the trigger cavity and out of the slot in the interior plate 48. Removing the latch from the slot in the interior plate permits movement of the trigger housing within the trigger cavity 30. Referring now to FIG. 6, to ignite the lighter 5, a user depresses the trigger 12, causing the trigger housing to descend through the cavity, and the concomitantly enabling the ignition substance 50, which is disposed on the outer surface of the trigger enclosure in the ignition cavity, to engage the ignition rod 49, causing ignition of the fuel to occur. Upon completion of use of the lighter, a user simply releases the trigger. A spring (not shown) urges the trigger enclosure to its original position (of FIG. 3). In addition, the release of the trigger causes the spring 43 to urge the lever 16 back to a flush position with the face 47 of the trigger. This releases the contact of the lever lip 62 from the Latch lip 60, allowing the spring 57 to force the latch 54 back into slot 52 when the trigger enclosure returns to its initial position.

Figure 7:
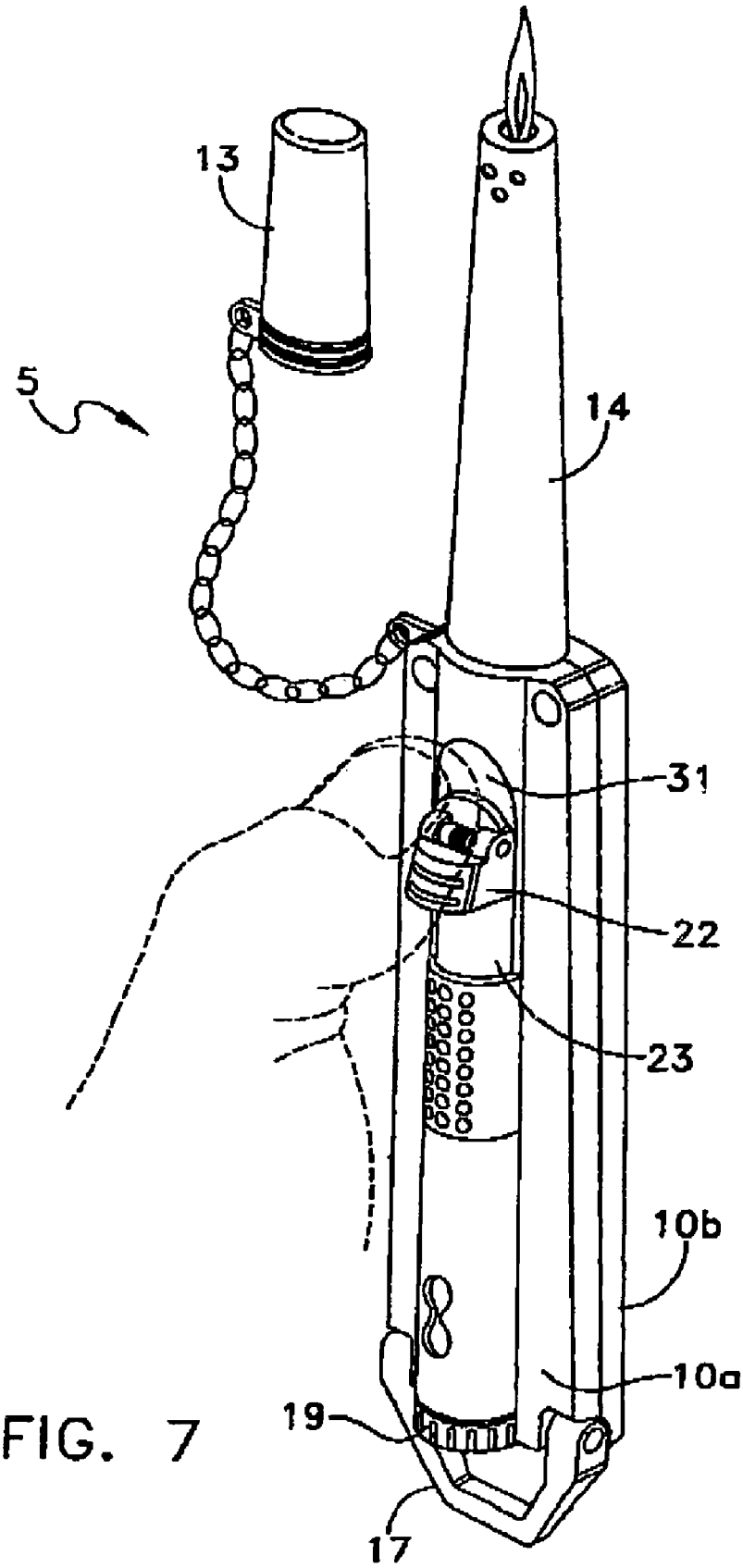
FIG. 7 is an external perspective of the lighter of the present invention, for illustrating the ease with which the trigger may be unlocked and engaged to ignite the lighter.

Referring now to FIG. 7, an external perspective of the lighter 5 is shown for illustrating user operation. As shown in FIG. 7, with only the thumb the user may lift the lever 16, thereby releasing the latch 54 and permitting depression of the trigger, and ignition of the lighter. When the user's thumb is placed between the lever and the trigger, no additional movement of the user is necessary to keep the lighter in an unlocked position. However, when the thumb is removed, the locking mechanism is automatically engaged.

Thus a lighter with a trigger mounted safety mechanism has been shown and described with numerous benefits over the prior art. Providing the lever in flush relation with the trigger obscures the function of the lever and makes it difficult for an uneducated user to unlock the device, thereby safeguarding the lighter against use by children. In addition, the design of the lighter of the present invention is easy to manipulate, because only one digit and one movement is required for operation; the spring design lever/finger placement of the present invention provides the unlatching force. Thus, this overcome the previous problems of the prior art that required force by multiple fingers or in multiple directions for use.

Having described various embodiments of the invention, it is understood that the present invention is not to be limited in scope by the specific embodiments described herein. Indeed, various modifications of the present invention, in addition to those described herein, will be apparent to those of ordinary skill in the art from the foregoing description and accompanying drawings. Accordingly, the present invention should only be limited by the attached claims.

We claim:

1. A lighter comprising:

a housing;

an interior plate positioned internally within the housing and defining an ignition cavity and a trigger cavity;

a trigger enclosure, comprising a first wall positioned in the housing adjacent to the interior plate and a second wall having an extension extending beyond an external face of the housing;

a trigger slideably mounted on the housing and including a lever pivotably mounted on the trigger;

a first spring, coupling the trigger to the lever, the spring for urging the lever to a position flush with a top face of the extension and defining a pivot point for the lever;

a slot, extending through the interior plate and the first wall of the trigger enclosure; and a latch, aligned with the slot and extending into the trigger enclosure, the latch extending through the interior plate of the lighter when the lighter is in the first, locked position;

the lever having a first, locked position for locking the lighter, wherein the lever is biased against an upper surface of the trigger, and a second position for permitting use of the lighter, wherein when the lever is pivoted upwardly from the upper surface of the trigger, the trigger can be moved downwardly from a first non-actuated position to a second, actuated position.

2. The lighter of claim 1, wherein, in the first position the lever lies flush on a top face of the trigger.

3. The lighter of claim 2, wherein the lever extends in length to match a front face of the trigger.

4. The lighter of claim 1, wherein the lever further comprises a lever lip positioned on an interior edge of the lever, extending perpendicularly from the lever into the trigger enclosure.

5. The lighter of claim 4, wherein the latch includes a latch lip, extending perpendicularly from a top surface of the latch towards the lever, wherein, when the lever rotates around the pivot point, the lever lip engages the latch lip to urge the latch out of the slot in the interior plate of the housing.

6. The lighter of claim 1, further including a second spring, disposed in an interior of the trigger enclosure and coupled to the latch, the spring for urging the latch into the slot of the interior plate.

7. The lighter of claim 1, wherein the first spring is a torsion spring.

8. The lighter of claim 6 wherein the second spring is a torsion spring.

9. The lighter of claim 1, wherein the trigger comprises an extension portion that protrudes from the housing having ridges formed thereon.

10. The lighter of claim 1, further comprising an ignition means, the ignition means comprising a first ignition substance coupled to the trigger enclosure and extending into the ignition cavity and a second ignition substance disposed within the ignition cavity, wherein when the lever is in the second position, the trigger enclosure may be moved to cause contact between the first ignition substance and the second ignition substance.

11. A child resistant lighter comprising:

a housing;

a trigger enclosure slideably mounted on the housing;

an ignition means, the ignition means comprising a first ignition substance disposed on a portion of the trigger enclosure within the housing; and a second ignition substance disposed in the housing;

a slideable latch having a first position for prohibiting movement of the trigger enclosure within the housing and thereby prohibiting contact of the first ignition substance and the second ignition substance and a second position enabling movement of the trigger enclosure within the housing and thereby permitting contact of the first ignition substance and the second ignition substance; and a lever, coupled to the trigger, for controlling movement of the latch.

12. The child resistant lighter of claim 11 wherein the lever is integrated with the trigger in such a manner as to make the lever indiscernible to a casual observer.

13. The child resistant lighter of claim 11 including a spring, coupled to the lever, for urging the lever to a position that prohibits contact of the lever with the latch.

14. The child resistant lighter of claim 11 including a spring, disposed in the trigger housing, for urging the latch in the first position that prohibits movement of the trigger enclosure within the housing.

15. The child resistant lighter of claim 11, wherein the lever is pivotally mounted to the trigger, and includes a lip that extends into the housing, the lip for engaging the latch when the lever is rotated about a pivot point to move the latch to the second position.

16. A lighter comprising:

a housing, the housing having an external shell and an internal plate extending there through defining an ignition cavity and a trigger cavity;

a trigger enclosure, having a first internal wall adjacent to the internal plate of the housing and a second wall having an extension that extends beyond the shell of the housing, the trigger comprising a lever mounted pivotally thereon;

a latch, slideably positioned to extend through a slot, the slot extending through the internal plate of the housing and the internal wall of the trigger enclosure, the latch having a first position extending through the slot of the internal plate and the trigger enclosure to prevent movement of the trigger enclosure within the trigger cavity, and a second position extending into the trigger cavity and not within the slot of the internal plate, thereby permitting movement of the trigger enclosure within the trigger cavity, wherein movement of the latch to the second position is controlled by the lever.

17. The lighter of claim 16 comprising a first spring for urging the latch to the first position and a second spring for urging the lever to a position wherein it does not contact the latch.

18. The lighter of claim 17 wherein the lever pivots between a first position where it lies flush on an external surface of the trigger, the first position of the lever being the position wherein it does not contact the latch, and a second position wherein it is raised off of the trigger.

19. The lighter of claim 18, wherein the shell of the housing includes a depression for accommodating the lever when the lever is raised off of the trigger.

20. The lighter of claim 17 wherein the movement of the trigger enclosure within the trigger cavity results in ignition of the lighter.

21. A lighter comprising:

a housing, the housing including a first ignition means and a second ignition means, the contact of the first and second ignition means resulting in ignition of the lighter;

a trigger, the movement thereof for causing contact of the first and second ignition means;

means for preventing movement of the trigger; and means, pivotally mounted on the trigger, for enabling movement of the trigger.

22. The lighter of claim 21, wherein the means for preventing movement of the trigger includes a latch, internal to the housing, for blocking the movement of the trigger along a fixed path within the housing.

23. The lighter of claim 22, wherein the means for preventing movement of the trigger includes a spring, internal to the housing, for urging the latch in a position that blocks movement of the trigger along the fixed path.

24. The lighter of claim 22, wherein the means for enabling movement of the trigger includes means for moving the latch.

25. The lighter of claim 24, wherein the means for moving the latch comprises a lever, pivotally mounted by a spring on the trigger, capable of rotating around the spring and contacting the latch to cause movement of the latch.

26. The lighter of claim 21 wherein the means for preventing movement of the trigger comprises means for disabling the means for enabling movement of the trigger.

27. The lighter of claim 21, wherein the means for disabling comprises a spring, urging the means for enabling movement of the trigger into a disabled position.

28. The lighter of claim 21 wherein the means for enabling is disguised as part of the trigger.

29. A method of lighting a lighter having a housing, a trigger slideably mounted on the housing and a lever pivotally mounted on the trigger, the method comprising the steps of:

inserting a digit between the lever and the trigger to cause the lever to lift off of the trigger, and thus causing the lever to engage a latch internal to the lighter that prevents movement of the trigger within the housing, and thereby move the latch to a position enabling movement of the trigger;

sliding the trigger on the housing to cause a first ignition means mounted on the housing to contact a second ignition means within the housing, resulting in ignition of the lighter.

* * * * *